US011063366B2

(12) United States Patent
Rockberger et al.

(10) Patent No.: US 11,063,366 B2
(45) Date of Patent: Jul. 13, 2021

(54) DEVICE AND METHOD FOR FOLDED DEPLOYABLE WAVEGUIDE

(71) Applicant: NSL COMM LTD, Airport City (IL)

(72) Inventors: Daniel Rockberger, Ra'anana (IL); Raz Itzhaki-Tamir, Rishon Le-Zion (IL); Daniel Spirtus, Holon (IL)

(73) Assignee: NSL COMM LTD, Airport City (IL)

( * ) Notice: Subject to any disclaimer, the term of this patent is extended or adjusted under 35 U.S.C. 154(b) by 0 days.

(21) Appl. No.: 16/609,264

(22) PCT Filed: May 1, 2018

(86) PCT No.: PCT/IL2018/050481

§ 371 (c)(1),
(2) Date: Oct. 29, 2019

(87) PCT Pub. No.: WO2018/203334

PCT Pub. Date: Nov. 8, 2018

(65) Prior Publication Data

US 2020/0091612 A1 Mar. 19, 2020

Related U.S. Application Data

(60) Provisional application No. 62/500,587, filed on May 3, 2017.

(51) Int. Cl.
*H01Q 13/02* (2006.01)
*H01P 3/14* (2006.01)
(Continued)

(52) U.S. Cl.
CPC ..... *H01Q 13/02* (2013.01); *H01P 3/14* (2013.01); *H01P 3/16* (2013.01); *H01Q 1/08* (2013.01); *H01Q 1/288* (2013.01)

(58) Field of Classification Search
CPC ..... H01Q 1/08; H01Q 1/1235; H01Q 1/28; H01Q 1/288; H01Q 13/02; H01Q 15/161;
(Continued)

(56) References Cited

U.S. PATENT DOCUMENTS 2,464,598 A 3/1949 Meier et al.
2,636,083 A 4/1953 Phillips et al.
(Continued)

FOREIGN PATENT DOCUMENTS

CN 204885393 12/2015
EP 2 121 300 5/2016
(Continued)

OTHER PUBLICATIONS

Datashvili, L., Lang, M., Baier, H. and Sixt, T., 2005. Membranes for large and Precision deployable Reflectors, In Proc. of European Conference on Spacecraft Structures, Materials & Mechanical Testing 2005. Dec. 31, 2005 (Dec. 31, 2005).
(Continued)

*Primary Examiner* — Robert Karacsony
(74) *Attorney, Agent, or Firm* — Pearl Cohen Zedek Latzer Baratz LLP

(57) ABSTRACT

A foldable and deployable assembly for use to transfer RF signals comprises a RF transmitter/receiver adapted to operate in the RF range S and up, a transmit/receive horn unit to attach the assembly to an antenna operable in the RF range S and up and a foldable/deployable RF waveguide connected between the RF transmitter/receiver and the transmit/receive horn and operable in the RF range of S and up, the waveguide is formed as a hollow elongated piece made of at least one of silicone based shape memory composite carbon fiber reinforced silicone (CFRS) and graphite with silicone.

5 Claims, 5 Drawing Sheets

(51) Int. Cl.

| | |
|---|---|
| ***H01Q 1/28*** | (2006.01) |
| ***H01Q 1/08*** | (2006.01) |
| ***H01P 3/16*** | (2006.01) |

(58) Field of Classification Search
CPC ..... H01Q 15/20; H01Q 19/04; H01P 3/12; H01P 3/14; H01P 11/001; H01P 11/002; B64G 1/66
See application file for complete search history.

(56) References Cited

U.S. PATENT DOCUMENTS

| | | | |
|---|---|---|---|
| 3,331,400 | A | 7/1967 | Vilkaitis |
| 4,710,736 | A | 12/1987 | Stidwell |
| 2007/0025672 | A1 | 2/2007 | Suzuki et al. |
| 2017/0025745 | A1 | 1/2017 | Clayton et al. |

FOREIGN PATENT DOCUMENTS

| | | | | |
|---|---|---|---|---|
| JP | H04288705 | A | * | 10/1992 |
| JP | H07118604 | B2 | | 10/1992 |
| JP | 2000 254917 | | | 9/2000 |
| WO | WO0200811530 | | | 1/2008 |

OTHER PUBLICATIONS

Search Report of International Application No. PCT/IL2018/05048 dated Aug. 12, 2018.
Qin F et al: "A review of analysis of microwave absorption in polymer composites filled with carbonaceous particles", Journal of Applied Physics, American Institute of Physics; vol. 111 No. 6; Mar. 15, 2012.
European Search Report of Application No. EP 18 79 4762 dated Dec. 17, 2020.
Chinese Office Action of Application No. 2018800294181 dated Feb. 20, 2021.

* cited by examiner

| No. | Frequency (GHz) | Attenuation (db) |
|---|---|---|
| 1 | 20 | -0.10479 |
| 2 | 22 | -0.071054 |
| 3 | 24 | -0.057946 |
| 4 | 26 | -0.045071 |
| 5 | 28 | -0.043213 |
| 6 | 30 | -0.040689 |

Fig. 3B1

| No. | Frequency (GHz) | Attenuation (db) |
|---|---|---|
| 1 | 20 | -2.5731 |
| 2 | 22 | -1.5628 |
| 3 | 24 | -1.1521 |
| 4 | 26 | -0.91623 |
| 5 | 28 | -0.66723 |
| 6 | 30 | -0.040689 |

Fig. 3C1

DEVICE AND METHOD FOR FOLDED DEPLOYABLE WAVEGUIDE

CROSS-REFERENCE TO RELATED APPLICATIONS

This application is a National Phase Application of PCT International Application No. PCT/IL2018/050481, International Filing Date May 1, 2018, entitled "DEVICE AND METHOD FOR FOLDED DEPLOYABLE WAVEGUIDE", published on Nov. 8, 2018 as International Patent Application Publication No. WO 2018/203334, claiming the benefit of United States Provisional Patent Application No. 62/500,587 filed on May 3, 2017, which is incorporated herein by reference in their entirety.

BACKGROUND OF THE INVENTION

The satellites arena typically is characterized by tight limitations imposed on many physical dimensions of the satellite, such as overall weight, overall size when launched, amount of on-board fuel (chemical, electrical, other), size of deployable solar panels, size of parabolic (and other) antennas, etc. these limitations are mainly due to limits associated with the launching missile (weight, volume, etc.). On-going efforts are spent in minimizing the relevant physical dimensions of launched satellites, in order to enable minimizing of launching costs, expending launched satellites usability and the like. Accordingly, any part of such satellite that may be kept in a weight and/or size smaller at launching then when deployed—may enhance usability of the associated satellite and/or its commercial efficiency.

SUMMARY OF THE INVENTION

A foldable and deployable assembly for use to transfer RF signals is disclosed comprising a RF transmitter/receiver adapted to operate in the RF range S and up, a transmit/receive horn unit to attach the assembly to an antenna operable in the RF range S and up and a foldable/deployable RF waveguide connected between the RF transmitter/receiver and the transmit/receive horn and operable in the RF range of S and up, the waveguide is formed as a hollow elongated piece made of at least one of silicone based shape memory composite carbon fiber reinforced silicone (CFRS) and graphite with silicone.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
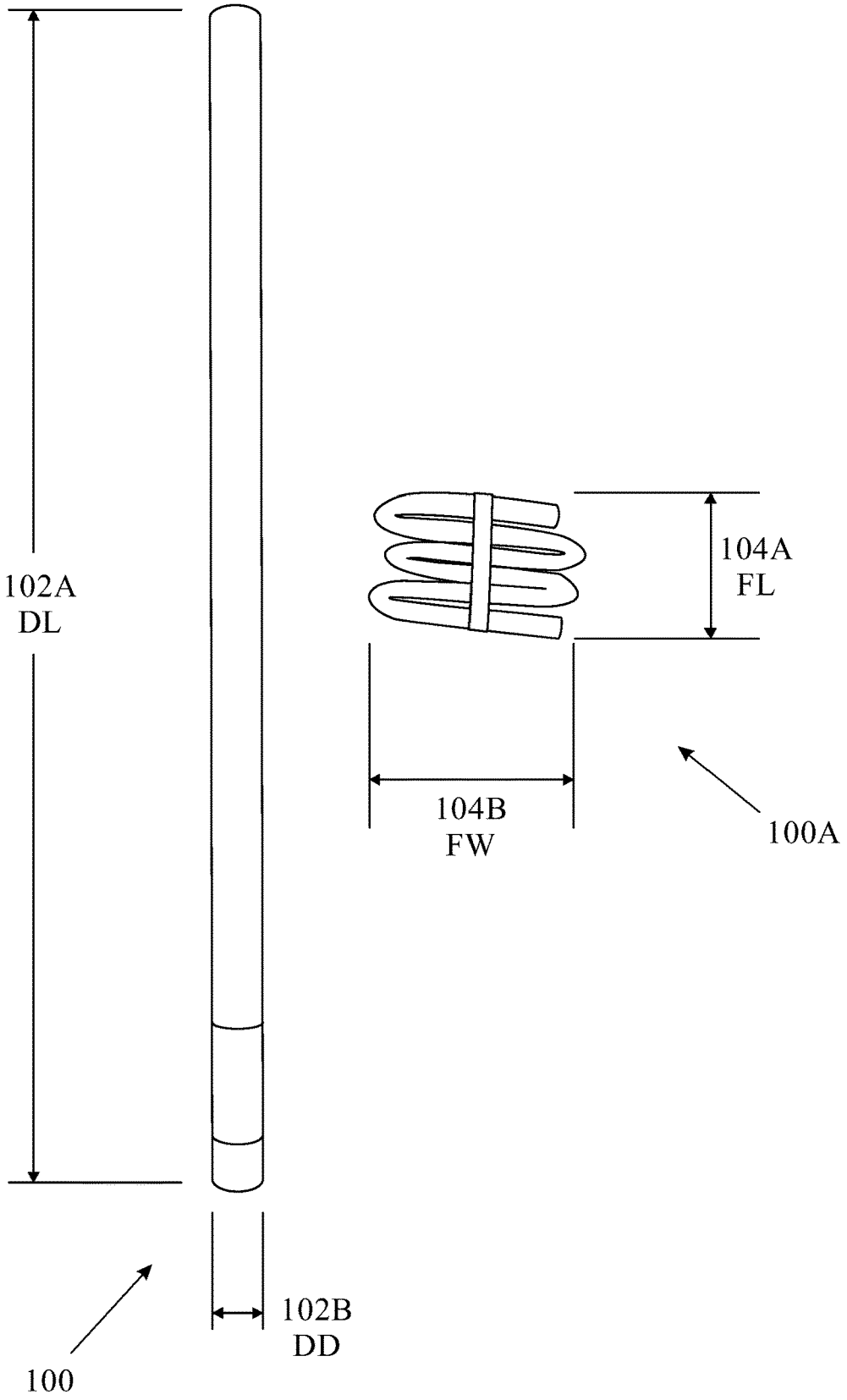
FIG. 1 presents a wave guide in its deployed position and in its folded position, according to embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

One structural element usable in satellites is a waveguide, used for transmitting very high frequency signals from a transmitter to an antenna or from the antenna to a receiver, or between active units operating in very high frequencies in the range of S and up. Coaxial cable may also be used however in the respective frequency ranges its associated losses are not negligible. To maximize efficiency and minimize losses of transmission bitrate, coax cables are not suitable and waveguides are needed.

The enhancements in micro electromechanical systems (MEMS) is driving the realm of small satellites to be able to become communication systems using frequencies solely used by now to the large Geostationary satellites, KU and KA bands. Use of MEMS devices may allow minimization of many elements of the satellites when in folded/stowed position and deployment of same when needed, with only very small added weight or consumed energy.

In order to enable stowing and launching of satellites while occupying as-low-as-possible volume, it is desired to enable minimization the size of launchable waveguides. Typical waveguides are made of metal with high electrical conductivity, in order to ensure operation with minimal power losses. Yet, metal made waveguide is not capable of folding, or otherwise minimizing its volume for launching without substantially losing electrical transmission efficiency due to implementation that will involve use of large number of structural connections which cause degraded transmission efficiency.

Using a rigid waveguide imposes a challenge because folding the rigid waveguide may most probably change its deployed form and size, thereby deteriorate its performance. Pop up, expendable or deployable systems are therefore needed, to enable launching in as-small-as-possible volume and deployment to the required form and dimension when needed.

Use of a silicone based shape-memory composite CFRS (carbon fiber reinforced silicone) tube is introduced, according to embodiments of the present invention. The CFRS tube may have sufficient reflectivity and electrical conductivity to act as a waveguide with less than 0.5 db loss at Ku and Ka bands. Reference is made now to FIG. 1 which presents wave guide 100 in its deployed position and wave guide 100A which is waveguide 100 in its folded position, according to embodiments of the present invention. Waveguide 100 may be a hollow, flexible tube made of, for example, CFRS. Waveguide 100 in its deployed position may have external dimensions having length DL (102A) and diameter DD (102B) which defines deployed occupied volume of DLxDDxDD. Due to its flexibility waveguide 100 maybe folded as seen in folded waveguide 100A, occupying volume of FLxFWxFD (folded length, folded width and folded height, respectively), which may be no more than 50% of the deployed volume and even less. For example, most of the volume of the hollow space inside the tube may be reduced. Due to its shape-memory, folded waveguide 100A, when released or otherwise unfolded, may restore its deployed shape 100 with negligible deformations.

Figure 2:
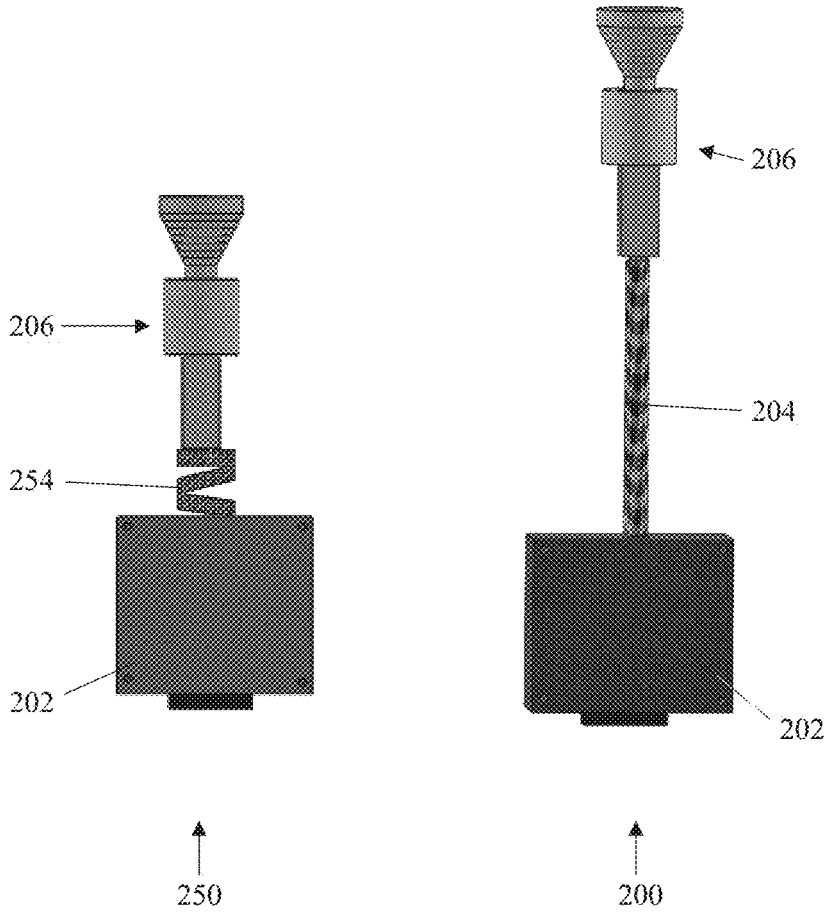
FIG. 2 is a schematic illustration of RF transmit/receive (TR/TX) assembly in its deployed position and in its folded position, according to embodiments of the present invention.

Reference is made now to FIG. 2, which is a schematic illustration of RF transmit/receive (TR/TX) assembly 200 in its deployed position and of TR/TX assembly 250 depicting assembly 200 in its folded position, according to embodiments of the present invention. TR/TX system 200 may comprise RF transmit/receive unit 202 connected y foldable waveguide 204 to RF feed horn 206. TR/TX assembly 200 may be folded into its respective folded position 250, for example in order to reduce its occupied volume when launched by a satellite launching missile. In the folded position flexible waveguide 204 may be folded, e.g. in Z form folding scheme, into folded position 254, thereby reducing the overall volume of TR/TX assembly 200 in its folded position.

The shape of a flexible waveguide, after deployment, may have undesired effect on its RF performance, therefore tolerances of its physical/geometric characteristics, such as concentricity, bend deflection, deployed cross section etc., must be kept within proper limitations.

In order to maintain these geometric requirements within a specified tolerance that keeps in range the RF requirements, the following parameters should be attended to: fibre type (Modulus), silicone resin type (Shor hardness number and elongation factor), waveguide wall thickness, waveguide cross section diameter, folding scheme (Z fold, roll, etc), Inner surface roughness (Ra) and waviness (mandrel material , release agent/means and surface tolerance of manufacturing.

In order to ensure the desired mechanical, geometric and electrical performance of a foldable/deployable waveguide according to embodiments of the present invention, silicone based shape memory composite CFRS (carbon fiber reinforced silicone) may be used to form the waveguide tube. According to yet additional embodiments the carbon may be graphite and silicone in the composite CFRS tube may be conductive, which may improve its RF performance. Such selection of materials has sufficient RF reflectivity and conductivity to enable it to act as a waveguide with less than 0.5 db loss at Ku and Ka wavelength bands.

Figure 3A:
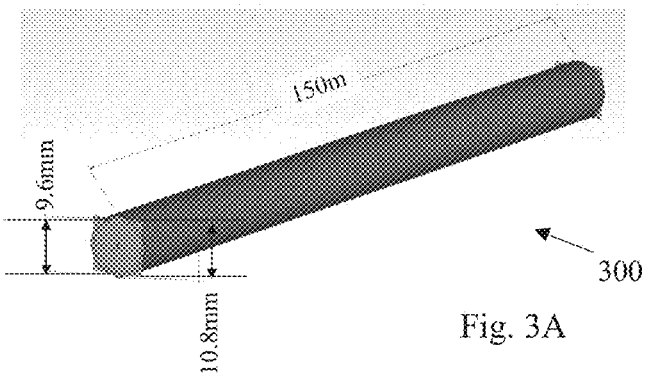
FIG. 3A depicts the dimensions of tested waveguide, according to embodiments of the present invention.
Figure 3B:
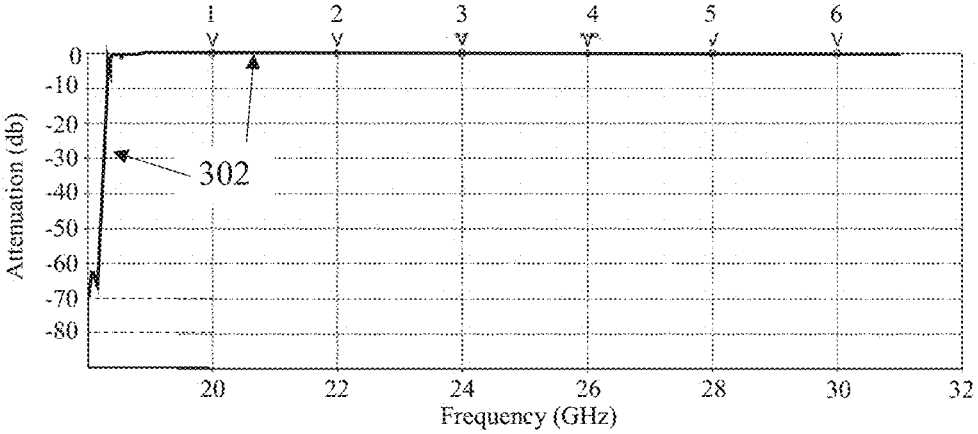
FIGS. 3B/3B1 and 3C/3C1 are graphs presenting the RF transmission performance of known wave guide and of unfolded/deployed waveguide, according to embodiments of the invention, respectively.

Foldable waveguide produced according to embodiments of the present invention has been tested for RF performance, after deployment from a folded position. Reference is made now to FIG. 3A depicting the dimensions of tested waveguide 300, and to FIGS. 3B/3B1 and 3C/3C1 which are graphs presenting the RF transmission performance of known aluminum wave guide and of unfolded/deployed waveguide according to embodiments of the invention, respectively. As may be seen, the well-known aluminum waveguide presents RF performance graph 302, in which for frequencies higher than 5 GHz the attenuation is substantially zero. The attenuation numbers are presented also in chart 3B1.

Figure 3C:
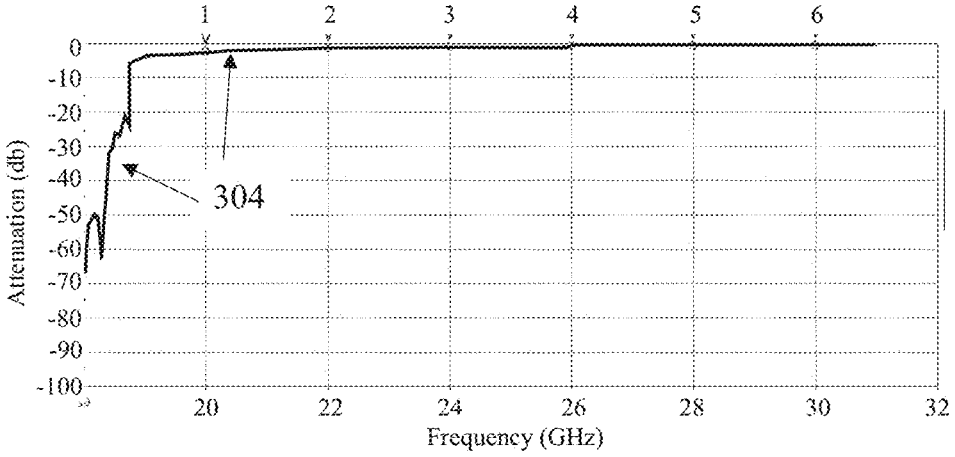

The performance of a foldable/deployable waveguide tube 300, structured according to embodiments of the present invention, are presented in graph 304 (FIG. 3C) and the performance numbers are also presented in a table in FIG. 3C1. As seen, the attenuation of deployed waveguide 300 in frequencies above 7 GHz is less than 5 db, above 10 GHz the attenuation is no more than 2.5 db and above 24 GHz the attenuation is less than 1 db.

Figure 4:
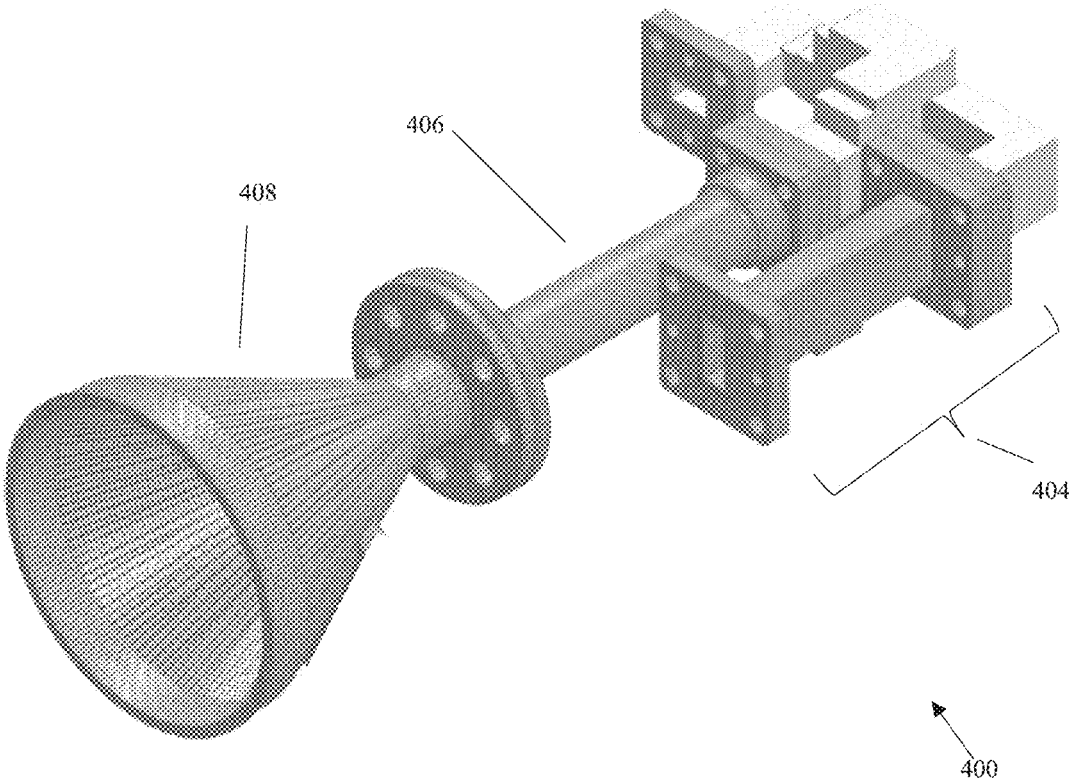
FIG. 4 is a schematic illustration of RF transmit/receive assembly 400 comprising Tx/Rx RF orthomode transducer (OMT) 402, a RF polarizer 404, a RF waveguide 406 and a Tx/Rx horn 408, according to embodiments of the present invention.

Reference is made now to FIG. 4, which is a schematic illustration of RF transmit/receive assembly 400 comprising Tx/Rx RF orthomode transducer (OMT) 404, a RF polarizer 406 and a Tx/Rx horn antenna 408, according to embodiments of the present invention. According to some embodiments at least on of elements 404, 406 and 408 may be made of flexible materials as is described with respect to waveguide 100 or 204. Accordingly, these elements may be kept in their folded/stowed position when launched and may be deployed when needed, thereby saving even more launching space. While the foldable elements 404, 406 and 408 are not presented in their folded position it would apparent to those skilled in the art that the folded position of each of these elements may have one of several forms which, due to the shape memory of the material of which these elements are made, when the folded position is released, the elements will return to their deployed position and form with minimal deflections and negligible effect on their performance.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A foldable and deployable assembly for use to transfer RF signals comprising:

a RF transmitter/receiver adapted to operate in the RF range S and up;

a transmit/receive horn unit to attach the assembly to an antenna operable in the RF range S and up; and a foldable/deployable RF waveguide connected between the RF transmitter/receiver and the transmit/receive horn and operable in the RF range of S and up, the waveguide is formed as a hollow elongated piece made of at least one of silicone based shape memory composite carbon fiber reinforced silicone (CFRS) and graphite with silicone.

2. The foldable and deployable assembly of claim 1, wherein a reflectivity and an electrical conductivity of the at least one of: silicone based shape memory composite carbon fiber reinforced silicone (CFRS) and graphite with silicone, are determined so that the foldable/deployable RF waveguide has less than 0.5 db loss at Ku and Ka bands.

3. The foldable and deployable assembly of claim 1, wherein a flexibility of the foldable/deployable RF waveguide is determined so that a volume occupied by the foldable/deployable RF waveguide in its folded state is no more than 50% of a volume occupied by the foldable/deployable RF waveguide in its deployed state.

4. The foldable and deployable assembly of claim 1, wherein an attenuation of the foldable/deployable RF waveguide in frequencies above 7 GHz is less than 5 db, in frequencies above 10 GHz the attenuation is no more than 2.5 db and in frequencies above 24 GHz the attenuation is less than 1 db.

5. The foldable and deployable assembly of claim 1, wherein at least one of: the RF transmitter/receiver and the transmit/receive horn unit, is made of at least one of: silicone based shape memory composite carbon fiber reinforced silicone (CFRS) and graphite with silicone, so that it may be folded and deployed when needed.

* * * * *